US007291032B1

(12) United States Patent
Carver et al.

(10) Patent No.: US 7,291,032 B1
(45) Date of Patent: Nov. 6, 2007

(54) CONNECTOR FOR ADJACENT DEVICES

(75) Inventors: Brian Luther Carver, Raleigh, NC (US); Henry Gaines McMillan, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/428,613

(22) Filed: Jul. 5, 2006

(51) Int. Cl.
*H01R 13/62* (2006.01)

(52) U.S. Cl. ..... 439/310

(58) Field of Classification Search ..... 439/310, 439/377, 259, 376; 361/727, 730–733, 785
See application file for complete search history.

(56) References Cited

U.S. PATENT DOCUMENTS

| | | | | |
|---|---|---|---|---|
| 3,917,372 | A * | 11/1975 | Selinko | 439/298 |
| 4,141,616 | A * | 2/1979 | Gottlieb | 439/263 |
| 4,540,227 | A * | 9/1985 | Faraci | 439/64 |
| 5,049,091 | A * | 9/1991 | Tanaka | 439/500 |
| 5,128,830 | A | 7/1992 | Deluca et al. | |
| 5,167,520 | A * | 12/1992 | Henry et al. | 439/266 |
| 5,203,021 | A * | 4/1993 | Repplinger et al. | 455/575.9 |
| 5,205,753 | A * | 4/1993 | Butterfield et al. | 439/157 |
| 5,493,194 | A * | 2/1996 | Damiano et al. | 318/575 |
| 5,517,387 | A * | 5/1996 | Smith | 361/686 |
| 5,684,673 | A * | 11/1997 | Shibasaki et al. | 361/686 |
| 5,721,669 | A | 2/1998 | Becker et al. | |
| 6,418,027 | B1 * | 7/2002 | Suzuki et al. | 361/729 |
| 6,698,937 | B2 * | 3/2004 | Grimes et al. | 385/53 |
| 6,926,548 | B2 * | 8/2005 | Reasoner et al. | 439/310 |
| 2002/0081890 | A1 | 6/2002 | Obermaier | |
| 2003/0100217 | A1 | 5/2003 | Wu | |

FOREIGN PATENT DOCUMENTS

JP 2004069721 A2 3/2004

OTHER PUBLICATIONS

"Connector System Using Opto-Electronic Techniques to Avoid Contact Wear"; www.delphion.com; Aug. 1990; IBM Technical Disclosure Bulletin; Author JP Ford, PA—United Kingdom; pp. 1-2.

* cited by examiner

*Primary Examiner*—Neil Abrams
(74) *Attorney, Agent, or Firm*—Cynthia S. Byrd; Streets & Steele; Jeffrey L. Streets

(57) ABSTRACT

An apparatus and method for connecting servers within a rack-mounted server system. In one embodiment, a plurality of servers are positioned in respective bays of a rack. The bays generally constrain adjacent servers in a generally fixed spacing and in face-to-face alignment. A first server is moved within its bay relative to a second server until a connector on the first server is aligned with a mating connector on the second server. Alignment of the two mating connectors is detected by a position sensor, such as an LED-photodiode pair. A signal from the position sensor causes or at least allows the first and second connectors to be moved toward one another, either using a motor or a hand-actuated mechanism, to provide power and data communication between the servers. Once the connection is established, data is optionally transmitted via the optical sensor.

20 Claims, 9 Drawing Sheets

CONNECTOR FOR ADJACENT DEVICES

BACKGROUND OF THE INVENTION

1. Field of the Invention

The present invention relates to multi-conductor connectors for connecting digital computing devices in a rack system.

2. Description of the Related Art

Large computer systems are often consolidated into centralized data centers having multiple servers assembled in a rack. Rack-mounted systems conserve space and put the servers and infrastructure within easy reach of an administrator. Managing these systems can, therefore, be less problematic and less expensive than separately administering a multitude of scattered smaller servers. Some of the more compact server arrangements currently available include blade servers, such as the IBM eServer BLADECENTER (IBM and BLADECENTER are registered trademarks of International Business Machines Corporation, Armonk, N.Y.). Blade server designs range from ultra-dense, low-voltage servers to high-performance, lower density servers, to proprietary, customized rack solutions.

In many conventional rack-mounted systems, the individual servers are typically configured in a stacked relationship, one above the other. In blade-type configurations, the individual servers are typically configured in a side-by-side relationship. In both configurations, multiple servers are generally positioned in adjacent bays within a rack enclosure. The servers may then be interconnected with cables, such as for scalability. For example, two blade servers, each having eight-processors, may be coupled together in electronic communication to effectively create a sixteen-processor server. Particularly in larger systems, however, it takes a significant amount of time to connect multiple servers. The cables used to manually connect the servers are subject to normal wear and tear, as well as potential breakage if mishandled. The steps and supplies involved in connecting servers in rack systems may represent a significant factor in the overall time, cost, and complexity of server installation and maintenance.

Therefore, there is a need for an improved method and apparatus for coupling servers in rack-mounted systems. It would be desirable for the method and apparatus to allow servers to be connected more efficiently and reliably, with less wear and tear on component parts. Preferably, the method and apparatus would reduce the manual involvement required to connect servers.

SUMMARY OF THE INVENTION

In one embodiment, an apparatus includes a rack having first and second adjacent server bays. The first and second server bays constrain servers at a fixed spacing and with face-to-face alignment. A first server is selectively positionable in the first server bay, and a second server is selectively positionable in the second server bay. The first server has a first connector, and the second sever has a second connector for electrical communication with the first connector. The first and second connectors are disposed at a common position on adjacent faces of the servers. A sensor is configured for detecting alignment of the first connector with the second connector and generating a signal in response. An actuator is configured for selectively extending at least one of the first and second connectors to establish electrical communication between the first and second connectors in response to the signal.

In another embodiment, a method includes positioning a first server in a first rack bay of a rack. A second server is positioned in a second rack bay adjacent to the first server. The first and second rack bays constrain the first and second servers at a substantially fixed spacing and with face-to-face alignment. A position of the second server relative to the first server in one translational direction is electronically detected. One or both of a first electronic connector on the first server and a second electronic connector on the second server are extended into electrical communication when the position of the second server relative to the first server corresponds to alignment of the first and second electrical connectors.

DETAILED DESCRIPTION OF PREFERRED EMBODIMENTS

The present invention provides improved connections for adjacent servers and other processors in a computer system. The invention is particularly well-suited for use with rack-mounted computer components, such as rack-mounted servers, wherein a plurality of servers are mounted in proximity to one another. The embodiments discussed, however, are not intended to limit the scope of the invention to connecting rack-mounted servers. Other embodiments include connections between other electrical components, such as between two hard drives. In some embodiments, existing server designs and other hardware designs may be modified, to preserve existing geometry and features of the servers or other hardware. In other embodiments, new servers or other hardware may be designed and developed to incorporate improved connections according to the invention.

Figure 1:
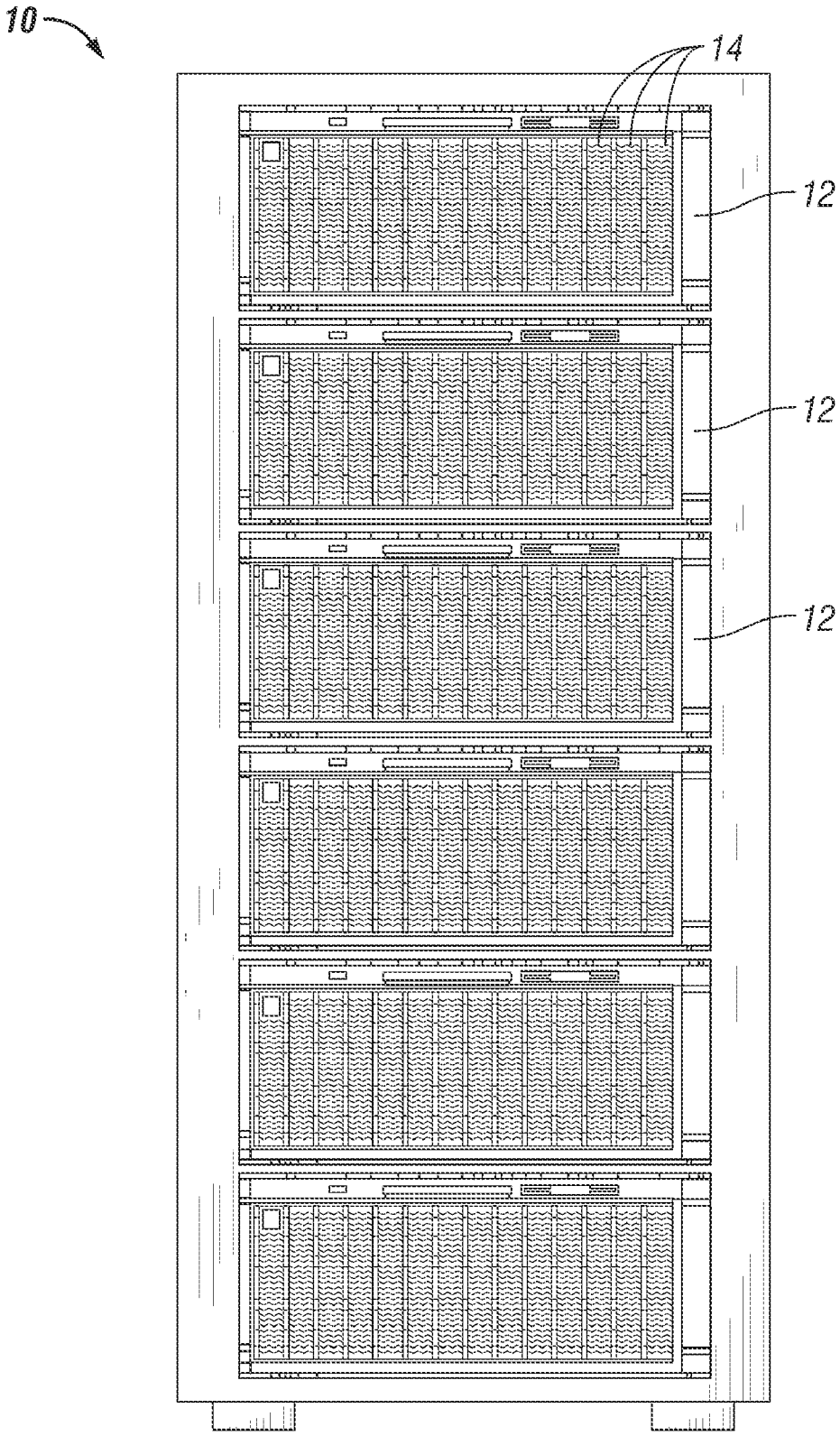
FIG. 1 is a front view of an exemplary rack system having multiple rack enclosures.
Figure 2:
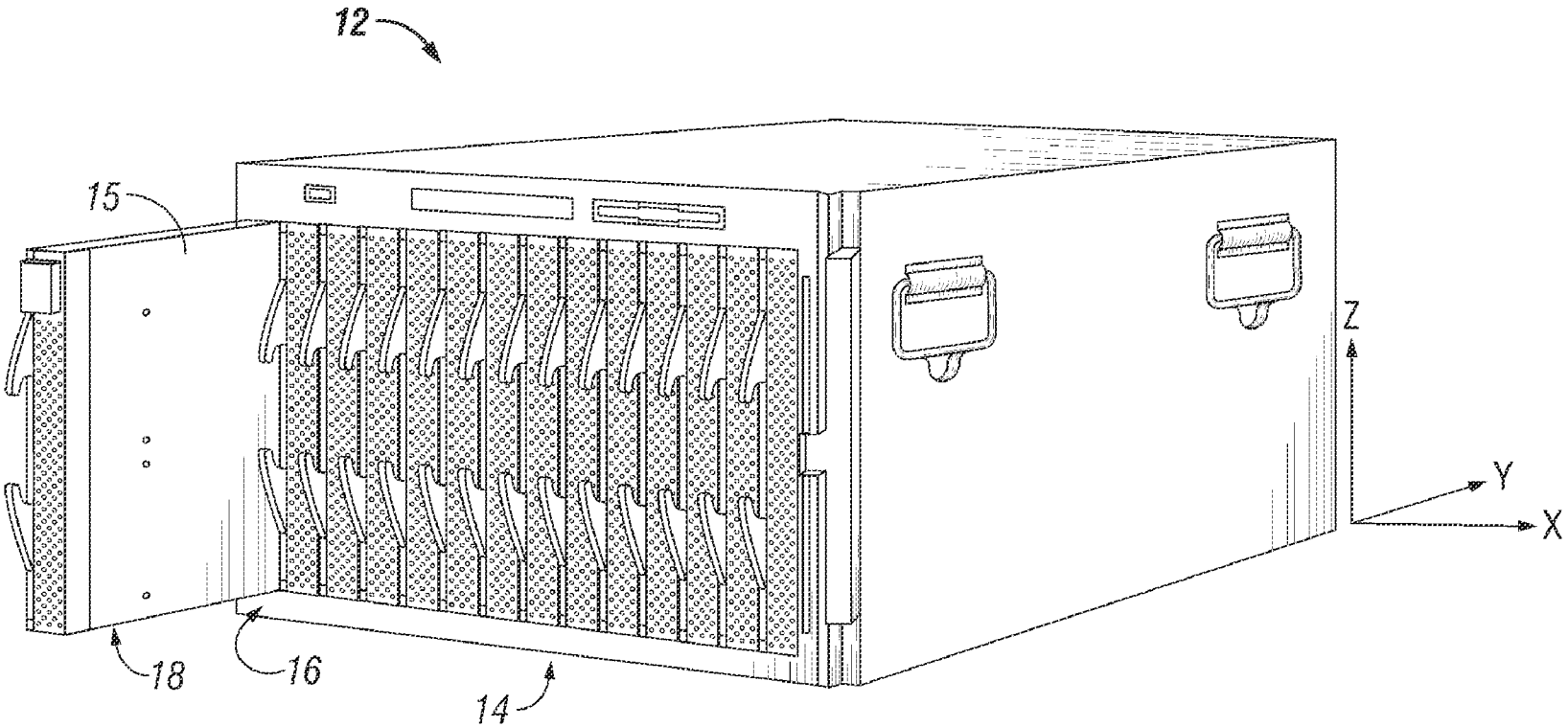
FIG. 2 is a perspective view of a rack enclosure with server blades slidably inserted.

FIG. 1 is a front view of an exemplary rack system 10 having multiple rack enclosures 12 mounted therein. A plurality of cooperating server blades 14 are positioned within each enclosure 12. FIG. 2 is a perspective view of one rack enclosure 12 with server blades 14 slidably inserted. For example, a blade 18 is shown partially inserted within a rack bay 16. The blade 18 has an individual server enclosure 15 housing a plurality of electronic components, such as CPUs, memory, PCI cards, fans, and hard drives. With reference to translational coordinates (x,y,z) in FIG. 2, the rack bay 16 substantially constrains the blade 18, in terms of lateral (x) translation and vertical (z) translation, but is moveable by the user in a y direction, into and out of the bay 16. The bay 16 also constrains the blade 18 rotationally, fixing its orientation in a substantially parallel relationship with adjacent blades 14. Thus, the rack enclosure 12 constrains the servers at a fixed spacing and with face-to-face alignment. Depending on how tightly the blade 18 fits in the bay 16, there may be a slight degree of lateral, vertical, or rotational "play" between the blade 18 and the rack bay 16, without appreciably affecting the generally fixed spacing and parallel alignment of the blades 12.

Figure 3:
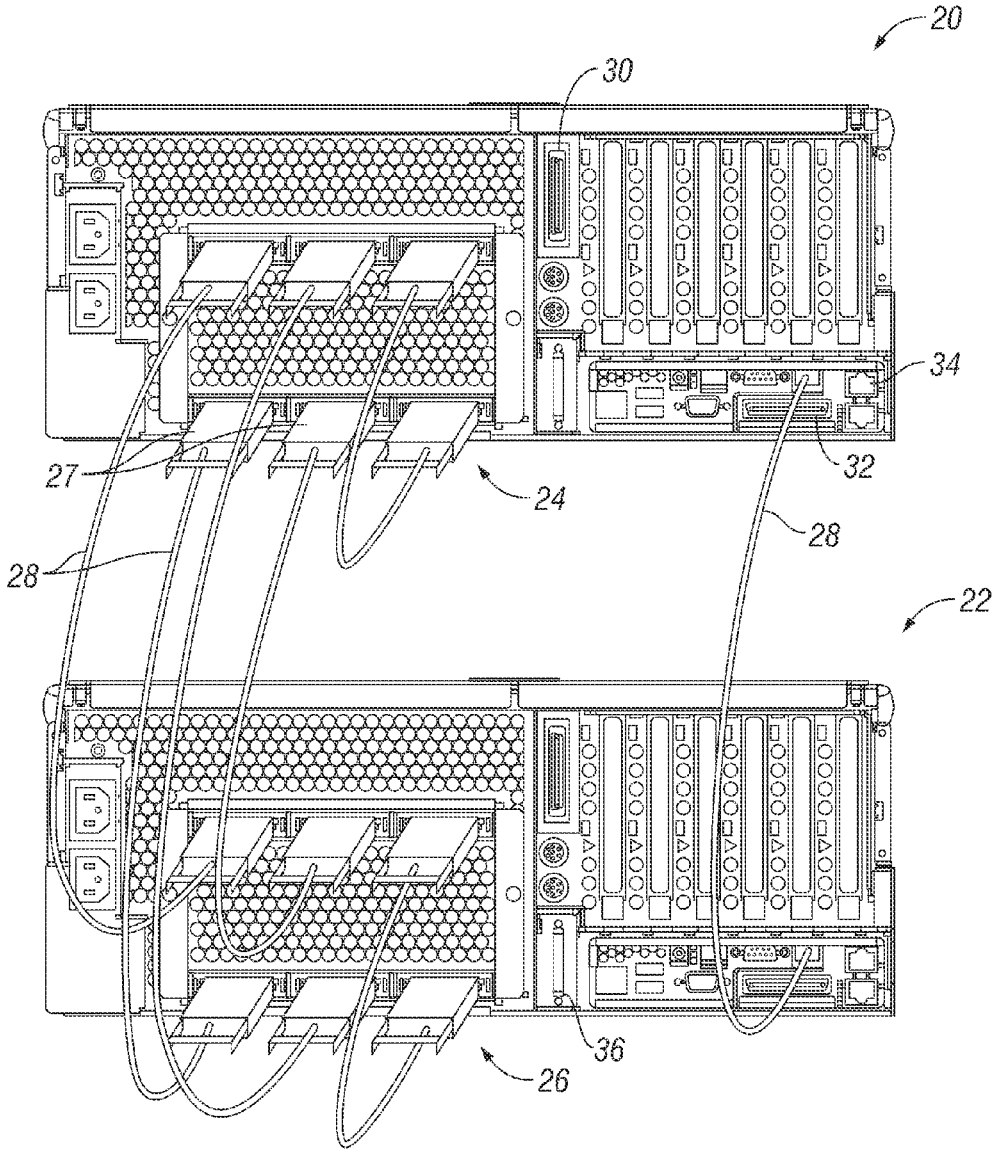
FIG. 3 shows a rear view of two exemplary server modules that, in one embodiment, may be modified according to the present invention.

FIG. 3 shows a rear view of two server modules 20, 22 that may be modified according to the present invention. Each server module 20, 22 may be a blade server for mounting within a rack. Each server module 20, 22 houses several symmetric multiprocessing (SMP) modules having a plurality of processors. External connections for the SMP modules may be accessed at SMP expansion panels 24, 26. The SMP expansion panels 24, 26 are connected with SMP expansion cables 28 using connectors 27. A Crossover Ethernet cable 28 also connects between the server modules 20, 22. Other external connections on the servers include RXE expansion ports 30, 32, gigabit Ethernet ports 34, and SCSI ports 36.

Embodiments of the invention, such as those discussed further below, provide alternative connections for connecting between servers such as modules 20, 22, while preserving the geometry and other aspects of existing server designs. The improved connections may eliminate or at least reduce the number of cables needed for interconnecting servers. For example, in one embodiment, the SMP expansion panels 24, 26 of FIG. 3 may be replaced with a connection system that eliminates the need for SMP expansion cables 28. In other embodiments, further connections between adjacent servers may be modified or improved, such as connections made to or between RXE expansion ports, Ethernet ports, SCSI ports, and even power terminals. Thus, the overall ease and efficiency of installing, configuring, and maintaining rack servers may be improved.

Figure 4:
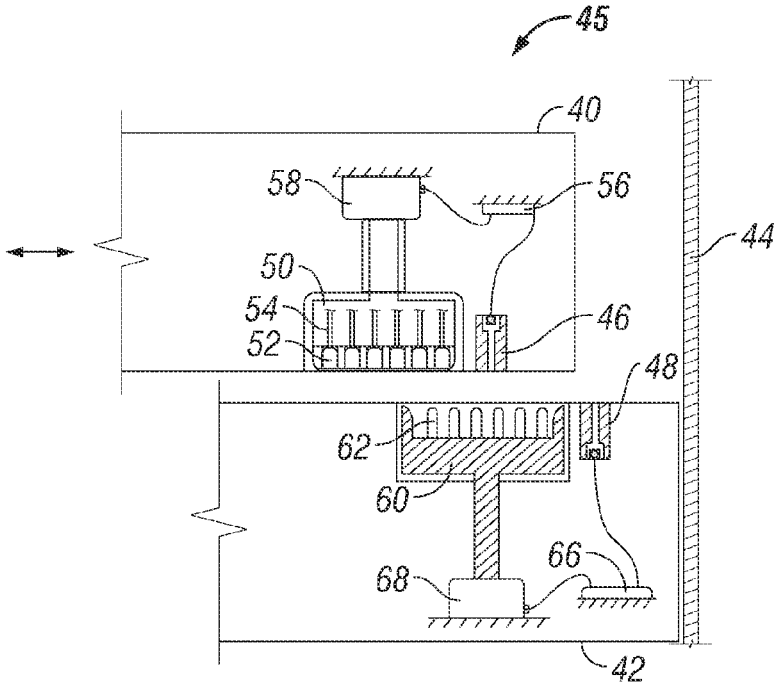
FIG. 4 is a schematic top view of an embodiment of the invention wherein two adjacent blade servers are not yet fully positioned and aligned.

FIG. 4 is a schematic top view showing a portion of a rack system 45 according to one embodiment of the invention. A pair of servers 40, 42 are slidably positioned adjacent one another within the rack system 45. As discussed in reference to the racks of FIGS. 1 and 2, the adjacent servers 40, 42 are received in predefined slots or bays (not shown) and secured in a particular position and orientation. In particular, the servers 40, 42 are at a generally fixed lateral spacing and face-to-face alignment, but may be slid or otherwise moved in a generally "y" direction, as shown. Server 42 is shown fully inserted within the rack system 45, abutting a rack enclosure 44. As shown, the server 40 is not yet fully inserted within the rack system 45 and may be slid further in its bay toward alignment with the server 42 with respect to the y-axis. Optical sensor members 46, 48 are included within the servers 40, 42. The optical sensor member 48 may, for example, be a light-emitting diode (LED), and the optical sensor member 46 may be a photodiode capable of sensing optical signals emitted by the LED 48. The servers and the rack bays are configured so that when the server 40 is pushed fully into its bay, the photodiode 46 will be aligned to detect optical signals emitted from the LED 48, and a female connector 50 will be aligned with a male connector. However, in the position of FIG. 4, the photodiode 46 is not yet aligned with the LED 48, and the female connector 50 is not yet aligned with the male connector 60.

The female connector 50 is recessed within the server 40. The female connector 50 includes a plurality of female terminals 52 connected to electrical leads 54. The electrical leads are optionally in electrical communication with a processor 56 or another processor or component. The male connector 60 is recessed within the server 42. The male connector 60 includes a plurality of male terminals 62, each receivable within a respective one of the female terminals 52 when the male connector 50 and the female connector 60 are subsequently connected. The male terminals 62 may be connected to electrical leads that are optionally in electrical communication with a processor 66 or another processor or component. Each processor 56, 66 may include an SMP module having a plurality of processor chips. The female connector 50 may be connected with male connector 60, such as to couple the SMP modules of the servers 40, 42 for scalability. An electric motor 58 is optionally included with the server 40 for moving the female connector 50 outward toward the male connector 60. An electric motor 68 is optionally included for moving the male connector 60 outward toward the female connector 50. The server 40 in FIG. 4 may be pushed in further toward the chassis 44 in the y-direction until it reaches the aligned position shown in FIG. 5. During typical operation, the server 40 will be secured in the fully inserted position shown in FIG. 5. Alignment in a vertical direction (out of the page) is generally fixed by virtue of the servers 40, 42 having common outer dimension and the rack bays supporting the servers 40, 42 at the same elevation. Therefore, alignment in the y-direction is the only remaining variable to completely align the connectors.

Figure 5:
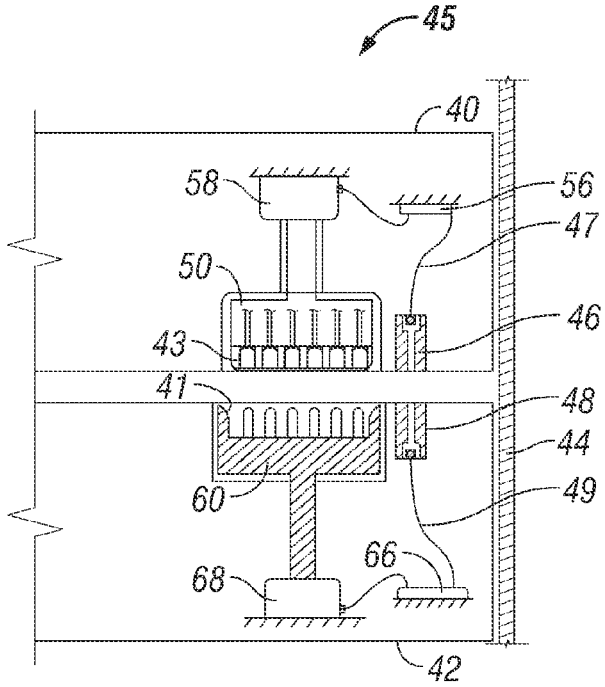
FIG. 5 is a schematic top view of the rack system of FIG. 4, showing the two adjacent blade servers fully positioned and aligned.

FIG. 5 is a schematic top view of the rack system 45 showing the servers 40, 42 aligned, with both servers being fully positioned within the rack system 45. The LED 48 is now aligned with the photodiode 46, and the male connector 60 is correspondingly aligned with the female connector 50. The photodiode 46 is, therefore, now able to detect optical signals from the LED 48. In response to the optical signals from the LED 48, the photodiode 46 may output an electrical signal to the processor 56 along electrical lead 47. The processor 56 may, in response, activate the motor 58 to drive the female connector 50 outward with respect to the server 40.

The servers 40, 42 may contain "cross-talk" circuitry (not shown) to communicate the occurrence of alignment back to the server from which the optical signal originated, to trigger movement of the connector located on that originating server. For example, when the photodiode 46 receives the optical signal from the LED 48, the server 40 may transmit a signal back to the processor 66. The processor 66 may, in turn, activate the motor 68 to drive the male connector 60 outward with respect to the server 42. Cross-talk circuitry may, for example, transmit an optical signal, a radio signal, or other signal from the server 40 back to the server 42 in response to the photodiode 46 receiving the optical signal from the LED 48. Alternatively, cross-talk may be provided between IR ports optionally included with each server 40, 42. In another embodiment, cross-talk may be provided by virtue of a reflective surface on a recipient server that reflects at least a portion of the optical signal back to the originating server. For example, a mirrored surface (not shown) on the server 40 may be configured to reflect a portion of the light from the LED 48 back to a photodiode or other optical receiver on the server 42 upon alignment of the servers 40, 42.

Figure 6:
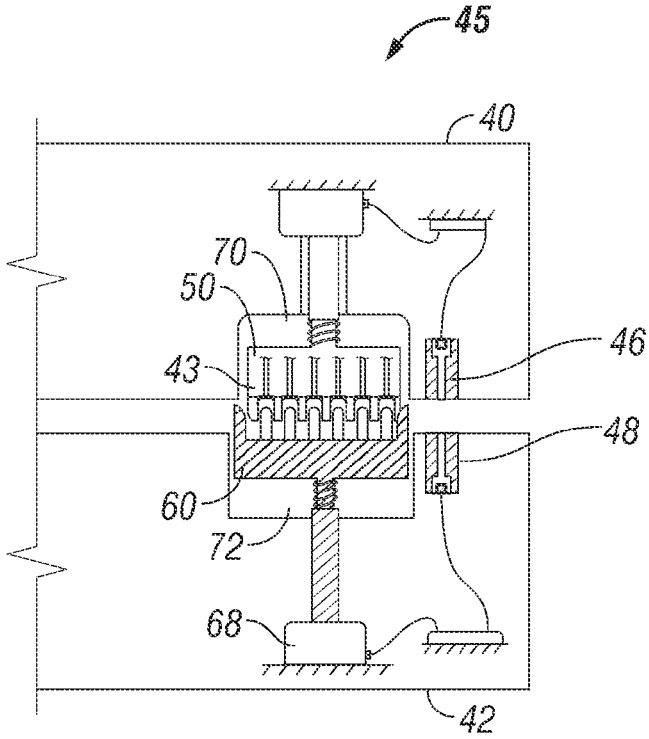
FIG. 6 is a schematic top view of the rack system of FIG. 5, wherein the female connector and male connector are extended outward into connection with one another.

The outward movement of the connectors 50, 60 causes the connectors 50, 60 to connect with each other, as in the position shown in FIG. 6. A shoulder 43 is preferably provided on the female connector 50 and a cooperating shoulder 41 is preferably provided on the male connector 60 to help ensure complete alignment of the connectors 50, 60 during their connection. In one embodiment, the optical system provides a rough alignment of the connectors, while the cooperating shoulders provide a final fine alignment as the terminals of the connectors engage.

FIG. 6 shows the female connector 50 and male connector 60 connected after alignment. The female connector 50 has been driven by the motor 58 in a direction "outward" with respect to the server 40, and out of an optional recess 70 in the server 40. Likewise, the male connector 60 has been driven by the motor 68 in a direction outward with respect to the server 42, and also out of an optional recess 72 in the server 42. The optional recesses 70, 72 provide protection for the connectors 50, 60 when the servers 40, 42 are being slid into or out of position in the rack system 45. The optional recesses 70, 72 also minimize the profile of the servers 40, 42 to minimize interference of the servers 40, 42 with each other, the rack, or another component.

Each server 40, 42 may include an on-board power supply, such as a rechargeable battery, for powering components even when the servers 40, 42 are not fully positioned in the rack system 45 or connected with each other. For instance, the on-board power supplies may power the photodiode 46 and the LED 48 as required for alignment. The on-board power supplies may also power the motors 58, 68 for driving the male connector 60 and the female connector 50 into connection. One or more servers in the rack system may act as an "anchor" server. The anchor server may be positioned in its bay in the rack system 45 and physically plugged into a rack power supply and data communication port. Power and data may be distributed from the anchor server to each subsequently installed server in the rack system 45 by virtue of their interconnection. For example, the server 42 may be plugged into the anchor server (not shown), to receive power from the anchor server. The server 40 may, in turn, receive power from the server 42 when fully aligned and connected with the server 42, and so on. The rack power supply may thereby provide power to the servers while connected in the rack system 45. The rack power supply may also recharge the on-board power supplies of each server, in anticipation of any subsequent removal and re-insertions of the servers.

Figure 7:
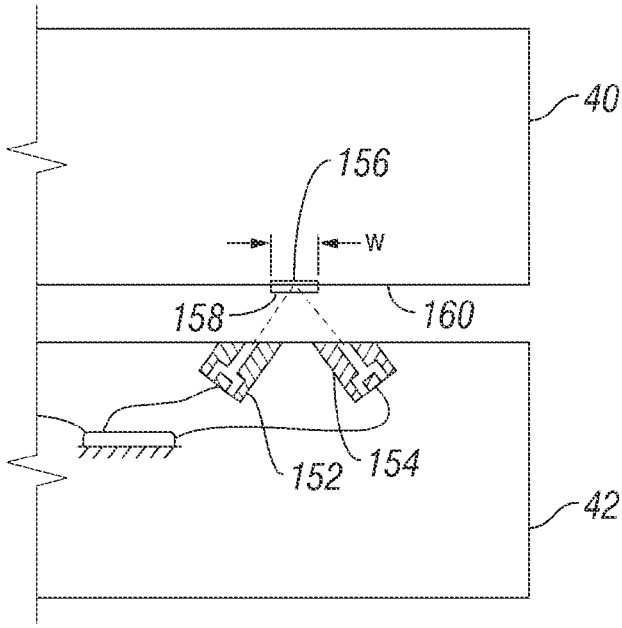
FIG. 7 shows an embodiment where an LED/photodiode pair is disposed on one server and a reflective insert is disposed on an opposing surface of an adjacent server.

According to one embodiment, a server that lacks an on-board power supply and is not otherwise receiving power may still be configured to participate in an alignment with an adjacent server that has already been installed and is receiving power. For example, FIG. 7 shows an embodiment wherein neither of the servers 40, 42 have an on-board power supply. The server 42 includes both an LED 152 and a photodiode 154. The server 42 is positioned in a rack system prior to the server 40 and is connected to a rack power supply, to power the LED 152, the photodiode 154, and other components of the server 42. The server 40 is not receiving any power prior to being connected with the server 42. However, the server 40 includes a narrow reflective insert 156 having a mirrored surface 158 that allows the server 40 to participate in its alignment with the server 42. The LED 152 and photodiode 154 on the server 42 are angled toward one another so that when a beam from the LED 152 strikes the mirrored surface 158 on the non-powered server 40, the beam reflects back to the photodiode 154 on the server 42, to activate a moveable connector disposed on the server 42. Once the server 40 is aligned and connected with the server 42, the server 40 may then receive power, such as through its connection with the server 42.

The position of the reflective insert 156 is selected so that the beam from the LED 152 is incident upon the mirrored surface 158 only when the server 40 is substantially aligned with the server 42. The reflective insert 156 preferably has a narrow width w, to minimize the range of position between the two servers 40, 42 that will cause the beam to reflect back to the photodiode 154. The degree of precision required for alignment is thereby governed, at least in part, by the width w. The surface 160 may be given a dark and/or dull finish, to minimize any reflection off of the surface 160, to prevent unintentional activation of the connector. Alternatively, a portion of the surface 160 may instead be polished to provide a reflective surface, while leaving the rest of the surface 160 dull and non-reflective.

Figure 8:
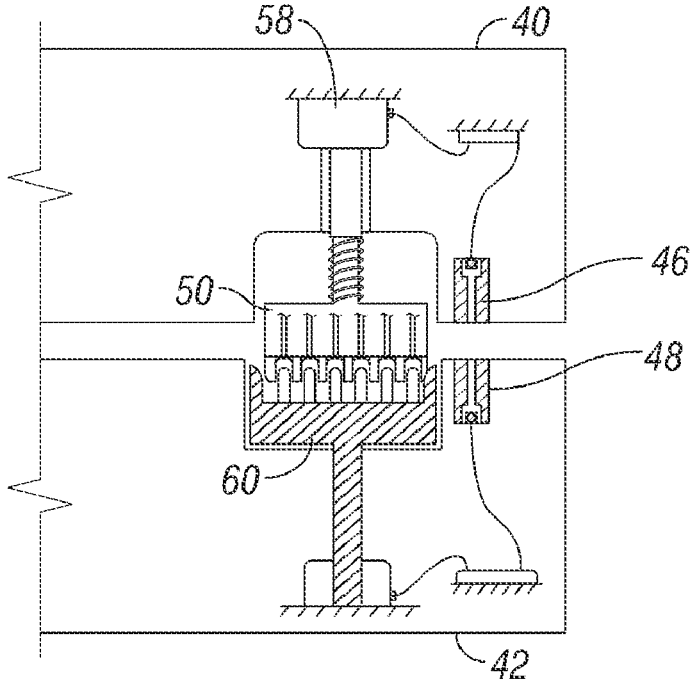
FIG. 8 is a schematic top view of the rack system of FIG. 5, wherein only the female connector is extended to connect the female connector with the male connector.

In one embodiment, only one connector is moved in response to server alignment. For example, FIG. 8 shows an embodiment wherein only the female connector 50 has moved, to connect the female connector 50 with the male connector 60. The female connector 50 is driven by the motor 58 in response to an electrical signal output by the photodiode 46 when the photodiode 46 detects the optical signal from the LED 48. The male connector 60 is optionally fixed within the server 42, as shown.

Figure 9:
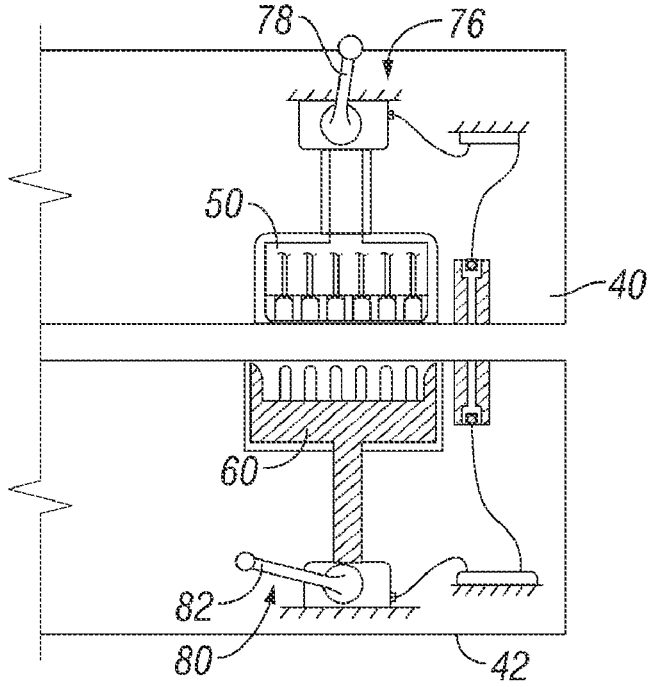
FIG. 9 is a schematic top view of the rack system of FIG. 5, wherein the connectors may be manually driven.

FIG. 9 shows another embodiment, wherein the connectors are manually driven. A hand-driven actuator 76 is included with the server 40 for driving the female connector 50 outward with respect to the server 40, toward the male connector 60. A crank 78 may be rotated by hand to drive the female connector 50 via a mechanism included with the actuator 76. Likewise, a hand-driven actuator 80 may be included with the server 42 for driving the male connector 60 outward toward the female connector 50. A crank 82 may be rotated by hand to drive the male connector 60 toward the female connector 50. The hand-driven actuators 76, 80 may include an interlock to prevent rotation of the cranks 78, 82 to prevent movement of the connectors 50, 60 prior to alignment.

Those skilled in the art will recognize a variety of other powered or hand-driven mechanisms that may be adapted for use with the invention, for moving the connectors. For example, pneumatic or hydraulically operated pistons, electrical solenoids, and other powered mechanisms may be used to drive connectors outward into connecting engagement with each other. Other types of hand-driven actuators may also be included for converting motion by hand to movement of the connectors. Hand-driven actuator embodiments are not limited to using rotating cranks.

A server may be disconnected from another server when it is desired to remove the server from the rack. In embodiments having powered actuators, such as a motor, piston, or solenoid, a signal to retract and thereby disconnect a connector may be provided by entering a command to an operating system or other software. Alternatively, a button or switch may be provided on the rack or on a server housing for signaling the connector to retract. In either case, one or more software steps may be performed prior to retracting the connector, such as to shut down any software currently utilizing the connector. For example, software used to communicate data between two connected servers may first be closed so that the connector may be disconnected without losing data or harming the servers. In embodiments with manually-driven connectors, the system may likewise be instructed by entering a command, pressing a button, or flipping a switch to shut down any software processes. Then, the connector may be manually retracted. An interlock may be provided as a safeguard so that the connector may not be manually retracted until certain steps have been taken, such as by shutting down related software.

Embodiments of the invention also allow more than two servers to be connected. To accomplish this, each server will preferably include a female connector, actuator and photo element directed in one direction and a male connector, actuator and cooperating photo element directed in the other direction. Adopting a standard arrangement of these elements allows the servers to be used interchangeably. Furthermore, although multiple servers may be connected using connectors according to the invention, at least some conventional connections may still be included with the servers or other components of the rack system, such as to connect the multiple servers with the rest of a rack system.

According to embodiments of the invention, the mating connectors are aligned prior to connection and the signal to extend the connector(s) is generated in response to alignment of the mating connectors. Thus, the position sensor detects the alignment of the mating connectors. This alignment detection may be done a number of ways, either directly or indirectly. In one embodiment, the position sensor can directly sense alignment of two connectors, such as in an embodiment having an LED-photodiode pair disposed directly on the mating connectors. In other embodiments, alignment of two connectors can be detected indirectly or inferentially according to known dimensions of the servers and server bays, even when the position sensors are not disposed directly on the connectors. For example, in the embodiments of FIGS. 4-6, the LED-photodiode position sensors are spaced from the mating connectors on the server housings. The server bays and the server housings have known dimensions, and are configured so that the connectors will also be in alignment when adjacent servers are fully seated within respective rack bays. The LED and the photodiode are located in such a way that the photodiode is aligned with the LED when each server is in its fully seated position. Thus, alignment of the mating connectors is detected inferentially when the photodiode detects the signal from the LED. In this way, even in embodiments wherein adjacent servers have dissimilar but known geometry and dimensions, the sensors can be located by the system designer so that the signal to extend the connector(s) is generated in response to an inference that the connectors are aligned.

In embodiments such as those of FIGS. 4-6, the LED-photodiode pair, which are configured to inferentially detect alignment of the connectors, are located on the servers, and are therefore constrained to move with the servers. Other sensors may inferentially detect alignment of the connectors by sensing positions of the servers with respect to a reference point that is not constrained to move with the first or second server. For example, in one embodiment, a rack may have a proximity sensor secured on the rack, rather than on the servers. The connectors on adjacent servers are located by the system designer to be aligned when pushed fully against their respective stops. The proximity sensor secured to the rack in each server bay senses when each server is fully positioned against its stop. When both servers are contacting their respective stops, indicating the desired alignment, the proximity sensor may output a signal causing motors on the servers to movably connect the connectors.

An LED-photodiode pair is one of many types of optical sensors that may be adapted for sensing position according to the invention. The LED-photodiode pair, as configured in the above embodiments, is a "position" sensor in that it is triggered in response to positioning of the connector of one server with respect to a mating connector on another server. An optical sensor as discussed herein includes any sensor that transmits and/or receives electromagnetic radiation. Optical signals may therefore include visible light, i.e. wavelengths visible to the human eye, as well as wavelengths outside the visible spectrum, such as infrared signals. Other optical signals may include laser beams. One advantage of embodiments having an optical sensor for sensing relative position of two servers is that the optical sensor may also be configured for transmitting data. For example, in one embodiment, an LED-photodiode pair may be configured so that, once aligned, the LED may transmit data to communicate between two or more servers. In another embodiment, an optical sensor may include at least one infrared port that both senses alignment and transmits data between servers. A variety of other optical or non-optical position sensors and proximity sensors are known in the art that may be adapted for use with embodiments of the invention.

Figure 10:
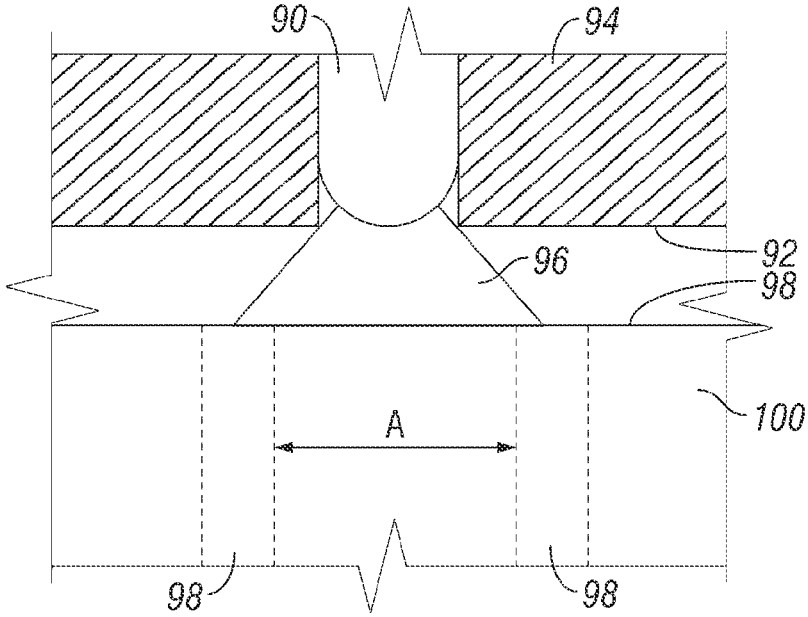
FIG. 10 show an embodiment wherein an LED is positioned flush with an outer surface of a server housing.
Figure 11:
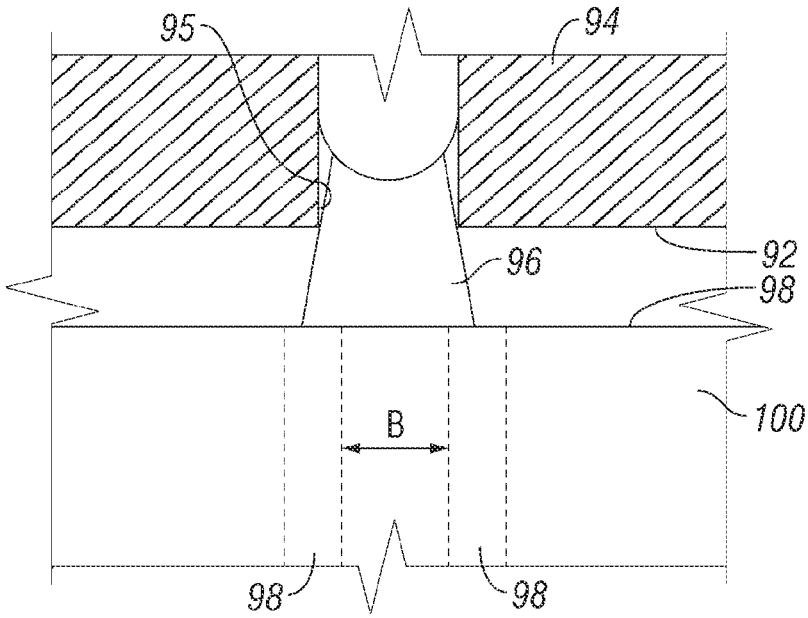
FIG. 11 shows an embodiment wherein an LED is recessed within the outer surface of the server housing.

It is generally desirable for the connectors not to move appreciably prior to alignment, to prevent potential damage that may occur if two connectors are inadvertently moved into contact with one another prior to alignment. Furthermore, some connector types may require more precise alignment than other connector types prior to connection, and other connector types may be more flexible or forgiving as to how precise the alignment must be prior to connection. In some embodiments, therefore, the optical position sensor may be recessed to a selected depth to control the degree of alignment necessary to trigger movement of the connectors. To illustrate, FIG. 10 shows an LED or other light source 90 positioned substantially flush with an outer surface 92 of a server housing 94. A relatively wide beam 96 is cast on a surface 99 of an adjacent server housing 100. The position at which a photodiode 98 may detect the beam 96 has a correspondingly large tolerance, indicated by two possible positions of the photodiode 98 separated by a distance A. By contrast, FIG. 11 shows the LED 90 recessed within the server housing 94. The beam 96 is significantly more focused and narrow as a result of the internal wall 95. The range of possible positions at which the photodiode 98 may detect the beam 96 has been correspondingly reduced, as indicated by positions of the photodiode 98 separated by a distance B, which is smaller than the distance A of FIG. 10. Thus, recessing the LED 90 increases the precision with which the two servers must be aligned in order to trigger movement of the connectors. Other steps to narrow the beam and provide more precise alignment will be apparent.

Figure 12:
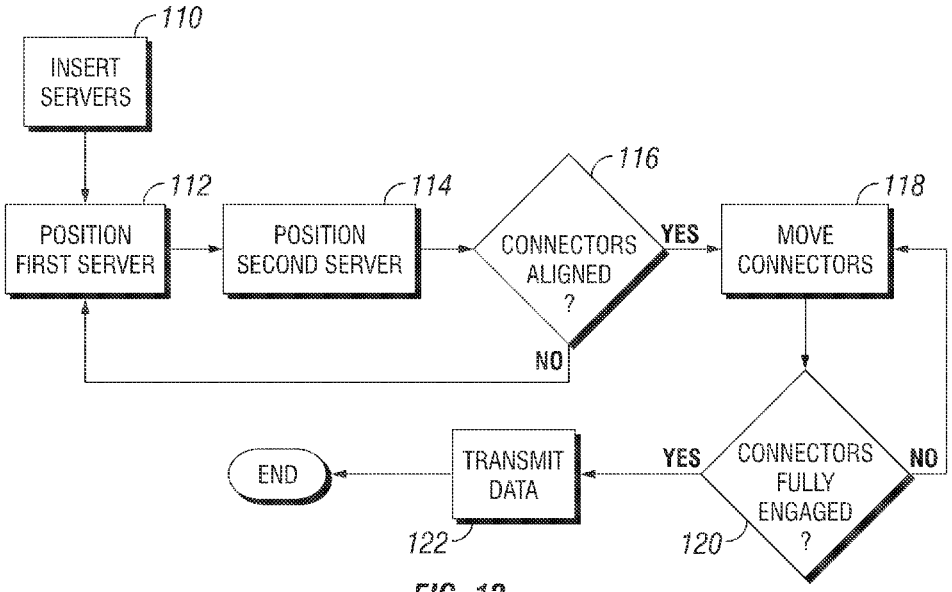
FIG. 12 is a flowchart illustrating one embodiment of a method of positioning and connecting servers in a rack system.

FIG. 12 is a flowchart illustrating a general method of positioning and connecting servers in a rack system. In step 110, two or more servers may be inserted within their respective bays in a rack. A first server is positioned in step 112, and a second server is positioned in step 114. In step 112, positioning the first server may comprise sliding the first server into its bay as far as it will go. In step 114, positioning the second server may comprise sliding the second server into its bay as far as it will go, and/or until an audible signal generated in response alerts the user that the connectors of the two servers are aligned. If necessary, the positions of either or both servers may be adjusted in steps 112 and 114. In step 116, the user may stop positioning the servers once the connectors are aligned. With the connectors aligned, one or both of the connectors may be moved outwardly toward one another in step 118. In step 120, the connector(s) continue to be moved, such as by using a motor or a hand actuator, until the connectors are fully engaged. Once fully engaged, a cooperative server pair has been established, and the connectors may begin transmitting data between each other and the rack system according to step 122.

Figure 13:
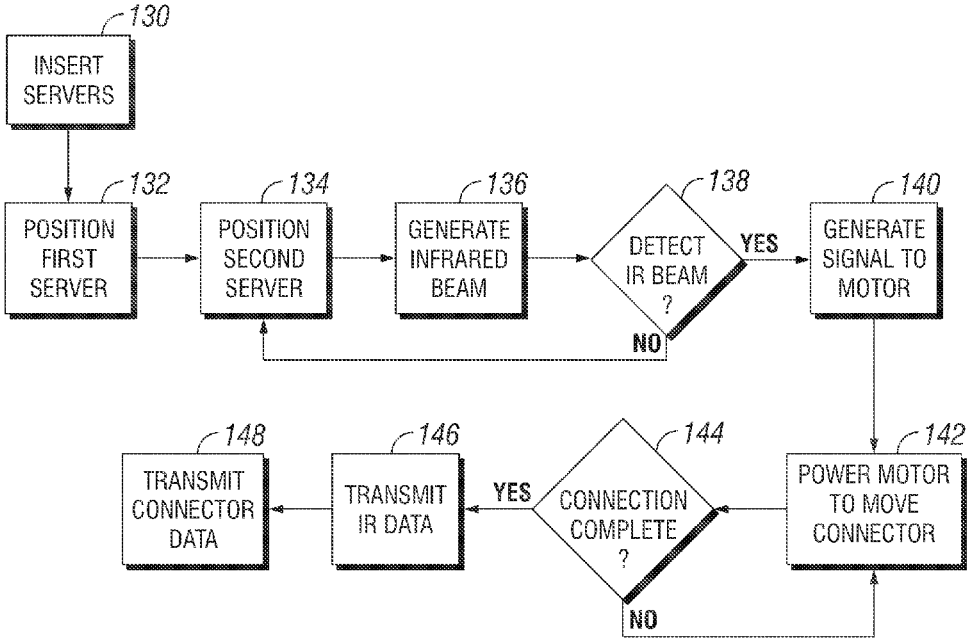
FIG. 13 is a flowchart illustrating a more detailed method of positioning and connecting servers in a rack system.

FIG. 13 is a flowchart illustrating a more detailed method of positioning and connecting servers in a rack system. In step 130 two or more servers are inserted within their respective bays. In step 132, the first server is positioned, such as by pushing it fully into its bay. In step 134, the second server is positioned relative to the first server. Meanwhile, an infrared beam is being generated using an LED in step 136. For example, an LED on the first server may be continuously transmitting an optical signal in the form of infrared radiation. A photodiode on the second server may be configured to detect the infrared beam once the infrared beam impinges on the photodiode, which is preconfigured to occur when the connectors are in the desired alignment. In step 138, if the infrared beam is not yet detected, the user may continue to position the second server (this example assumes the first server is already fully positioned). If the infrared beam is not yet detected, this typically means that the user has not yet fully inserted the second server into its bay.

Once the infrared beam is detected by the photodiode in step 138, an electrical signal is then generated from one or both of the LED on the first server and the photodiode on the second server. In step 140, the electrical signal from the LED is passed to a motor on the first server and the electrical signal from the photodiode is passed to a motor on the second server. In step 142, the motors are powered "on" to move a male connector and/or a female connector. For example, the electrical signal from the first server may actuate a male connector on the first server, and the electrical signal from the second server may actuate a female connector on the second server, to move the male and female connectors toward one another. Alternatively, where only one electrical signal is generated, only one of the two connectors may move. In step 144, the connection process is monitored, and once complete, power to the motors may be turned off. With the male and female connectors fully connected, the resulting paired servers may then communicate. In step 146, the LED and photodiode may transmit data between one another, taking advantage of their capability of infrared data transfer. In that regard, the optical sensor (LED-photodiode pair) in this embodiment serves a second function as an IR port. Additionally, data is typically transmitted over the completed male/female connection in step 148.

It should be recognized that the invention may include software elements, such as to control the sensors, movement of the connectors, and so forth. Thus, the invention may take the form of an entirely hardware embodiment, an entirely software embodiment, or an embodiment containing both hardware and software elements. In particular embodiments, including those embodiments of methods, the invention may be implemented in software, which includes but is not limited to firmware, resident software and microcode.

Furthermore, the invention can take the form of a computer program product accessible from a computer-readable medium providing program code for use by or in connection with a computer or any instruction execution system. For the purposes of this description, a computer-usable or computer readable medium can be any apparatus that can contain, store, communicate, propagate or transport the program for use by or in connection with the instruction execution system, apparatus or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W), and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

Figure 14:
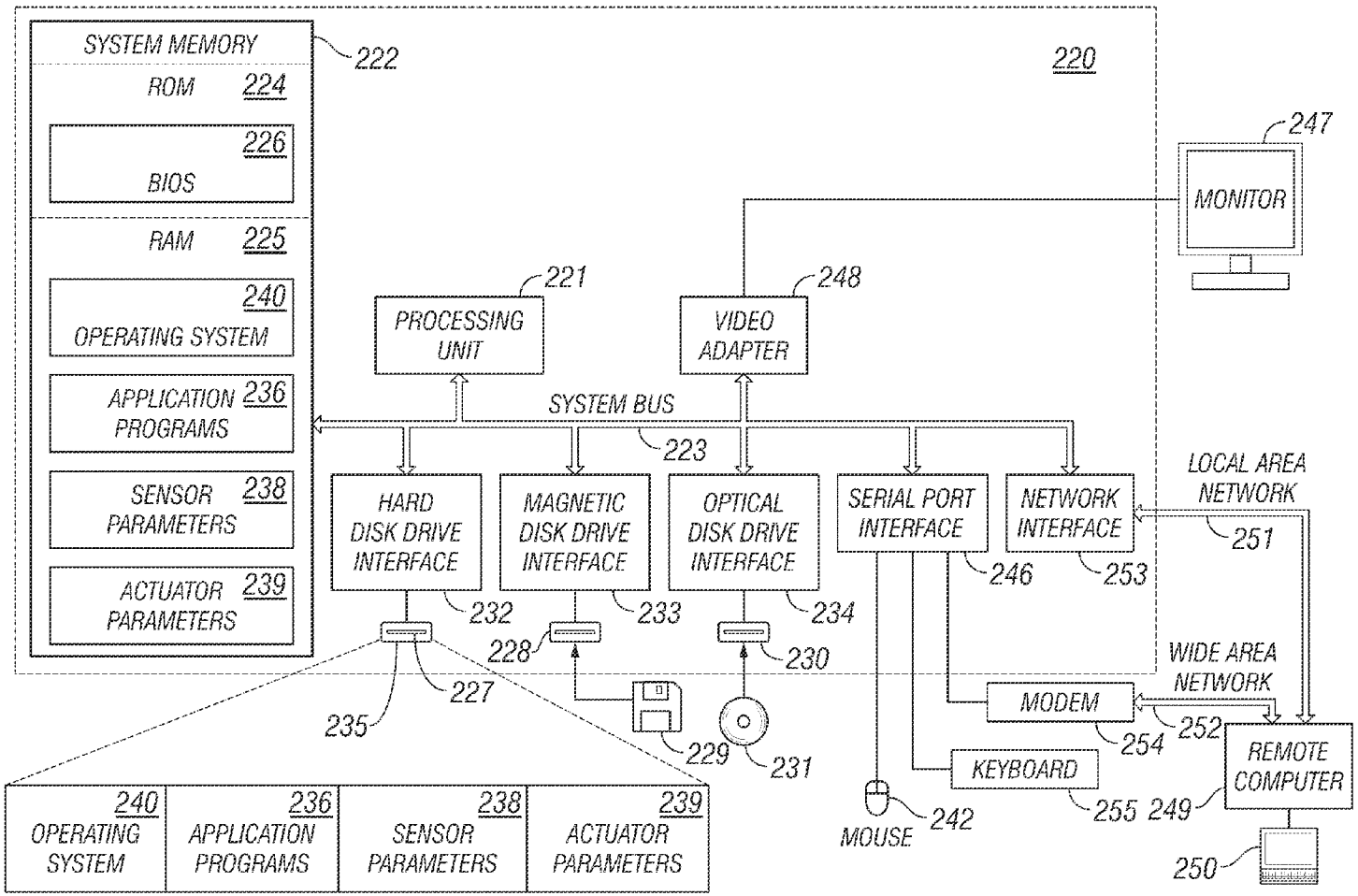
FIG. 14 a schematic diagram of a computer system that may be configured for positioning and aligning electrical components, such as servers and hard drives, according to an embodiment of the invention.

To illustrate, FIG. 14 is a schematic diagram of a computer system generally indicated at 220 that may be configured for positioning and aligning electrical components, such as servers and hard drives, controlling position sensors, operating actuators, and so forth, according to an embodiment of the invention. The computer system 220 may be a general-purpose computing device in the form of a conventional computer system 220. Generally, computer system 220 includes a processing unit 221, a system memory 222, and a system bus 223 that couples various system components, including the system memory 222 to processing unit 221. System bus 223 may be any of several types of bus structures including a memory bus or memory controller, a peripheral bus, and a local bus using any of a variety of bus architectures. The system memory includes a read only memory (ROM) 224 and random access memory (RAM) 225. A basic input/output system (BIOS) 226, containing the basic routines that help to transfer information between elements within computer system 220, such as during start-up, is stored in ROM 224.

Computer system 220 further includes a hard disk drive 235 for reading from and writing to a hard disk 227, a magnetic disk drive 228 for reading from or writing to a removable magnetic disk 229, and an optical disk drive 230 for reading from or writing to a removable optical disk 231 such as a CD-R, CD-RW, DV-R, or DV-RW. Hard disk drive 235, magnetic disk drive 228, and optical disk drive 230 are connected to system bus 223 by a hard disk drive interface 232, a magnetic disk drive interface 233, and an optical disk drive interface 234, respectively. Although the exemplary environment described herein employs hard disk 227, removable magnetic disk 229, and removable optical disk 231, it should be appreciated by those skilled in the art that other types of computer readable media which can store data that is accessible by a computer, such as magnetic cassettes, flash memory cards, digital video disks, Bernoulli cartridges, RAM, ROM, USB Drives, and the like, may also be used in the exemplary operating environment. The drives and their associated computer readable media provide non-volatile storage of computer-executable instructions, data structures, program modules, and other data for computer system 220. For example, the operating system 240 and application programs 236 may be stored in the RAM 225 and/or hard disk 227 of the computer system 220.

A user may enter commands and information into computer system 220 through input devices, such as a keyboard 255 and a mouse 242. Other input devices (not shown) may include a microphone, joystick, game pad, touch pad, satellite dish, scanner, or the like. These and other input devices are often connected to processing unit 222 through a USB (universal serial bus) 246 that is coupled to the system bus 223, but may be connected by other interfaces, such as a serial port interface, a parallel port, game port, or the like. A display device 247 may also be connected to system bus 223 via an interface, such as a video adapter 248. In addition to the monitor, personal computers typically include other peripheral output devices (not shown), such as speakers and printers.

The computer system 220 may operate in a networked environment using logical connections to one or more remote computers 249. Remote computer 249 may be another personal computer, a server, a client, a router, a network PC, a peer device, a mainframe, a personal digital assistant, an internet-connected mobile telephone or other common network node. While a remote computer 249 typically includes many or all of the elements described above relative to the computer system 220, only a memory storage device 250 has been illustrated in FIG. 14. The logical connections depicted in the figure include a local area network (LAN) 251 and a wide area network (WAN) 252. Such networking environments are commonplace in offices, enterprise-wide computer networks, intranets, and the internet.

When used in a LAN networking environment, the computer system 220 is often connected to the local area network 251 through a network interface or adapter 253. When used in a WAN networking environment, the computer system 220 typically includes a modem 254 or other means for establishing high-speed communications over WAN 252, such as the internet Modem 254, which may be internal or external, is connected to system bus 223 via USB interface 246. In a networked environment, program modules depicted relative to computer system 220, or portions thereof, may be stored in the remote memory storage device 250. It will be appreciated that the network connections shown are exemplary and other means of establishing a communications link between the computers may be used.

Program modules may be stored on hard disk 227, optical disk 231, ROM 224, RAM 225, or even magnetic disk 229. The program modules may include portions of an operating system 240, application programs 236, or the like. A sensor parameter database 238 may be included, which may contain parameters and procedures for controlling the various sensors. An actuator parameters database 239 may also be included, which may contain parameters and procedures for informing the system 220 about aspects of the actuators that may be used to move connectors.

Aspects of the present invention may be implemented in the form of application program 236. Application program 236 may be informed by or otherwise associated with status parameter database 238 and/or user preferences database 239. The application program 236 generally comprises computer-executable instructions for controlling the sensors and actuators to align and connect the servers or other components.

Embodiments of the invention have numerous advantages. The connection between adjacent serves may be at least partially automated. Servers may be connected more easily, using fewer loose parts, and with less wear and tear. The need for wires and cables to connect between adjacent servers may be reduced or eliminated. The steps required to connect the servers may be correspondingly reduced. The result is a more robust connection between servers involving less manual intervention. Servers may be connected faster, more reliably, and with less room for human error and damage to component parts. Those skilled in the art will recognize these and other advantages deriving from the various embodiments. However, none of the listed advantages are intended in a limiting sense.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred,""prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus, comprising:

a rack having first and second adjacent server bays for constraining servers at a fixed spacing and face-to-face alignment;

a first server selectively positionable in the first server bay, the first server having a first connector;

a second server selectively positionable in the second server bay, the second sever having a second connector for electrical communication with the first connector, wherein the first and second connectors are disposed at a common position on adjacent faces of the servers;

a sensor for detecting the alignment of the first connector with the second connector and generating a signal in response; and an actuator for selectively extending at least one of the first and second connectors to establish electrical communication between the first and second connectors in response to the signal.

2. The apparatus of claim 1, wherein the sensor comprises an optical sensor.

3. The apparatus of claim 2, wherein the sensor further comprises an LED on the first server and a photodiode on the second server, the photodiode configured for sensing an optical output of the LED.

4. The apparatus of claim 3, wherein the LED is recessed beneath an outer surface of the first server.

5. The apparatus of claim 1, further comprising at least one connector recess for receiving at least one of the first and second connectors.

6. The apparatus of claim 1, wherein the actuator comprises at least one motor for extending at least one of the first and second connectors.

7. The apparatus of claim 1, wherein the actuator comprises at least one hand-driven actuator configured for extending at least one of the first and second connectors.

8. The apparatus of claim 7, further comprising a locking mechanism for selectively preventing extension of the first or second connector prior to the signal from the sensor.

9. An apparatus, comprising:

a server adapted for positioning in a rack bay;

a first connector on the server including a plurality of electrical leads, the first connector configured for mating and electrical communication with a second connector on a second server, the second connector having a plurality of electrical leads; and a position sensor for detecting a position of the first connector relative to the second connector and generating a signal in response, the first connector being extendable in response to the signal from the position sensor.

10. The apparatus of claim 9, wherein the first connector is connected with the second connector when extended.

11. The apparatus of claim 9, wherein the second connector is extendable toward the first connector.

12. The apparatus of claim 9, wherein the position sensor further comprises an LED on one of the first and second servers, and a photodiode on the other of the first and second servers, the photodiode for sensing an optical output of the LED.

13. The apparatus of claim 12, further comprising a recess for recessing the LED below an outer surface.

14. The apparatus of claim 9, further comprising an electric motor configured for extending the first connector in response to the signal from the position sensor.

15. A method, comprising:

positioning a first server in a first rack bay of a rack;

positioning a second server in a second rack bay adjacent to the first server, the first and second rack bays constraining the first and second servers at a substantially fixed spacing and face-to-face alignment;

electronically detecting a position of the second server relative to the first server in one translational direction; and extending one or both of a first electronic connector on the first server and a second electronic connector on the second server in response to the electrical detection step and into electrical communication when the position of the second server relative to the first server corresponds to alignment of the first and second electrical connectors.

16. The method of claim 15, wherein positioning the second server with respect to the first server comprises moving one or both of the first and second servers within the respective first or second rack bays.

17. The method of claim 15, wherein positioning the second server with respect to the first server comprises aligning an LED on the first server with a photodiode on the second server.

18. The method of claim 17, further comprising transmitting data optically between the first and second servers.

19. The method of claim 15, further comprising extending the first or second electrical connector outward from a recess.

20. The method of claim 15, further comprising extending the first or second electrical connector with an electric motor.

* * * * *